US010781606B2

(12) United States Patent
Markham et al.

(10) Patent No.: US 10,781,606 B2
(45) Date of Patent: Sep. 22, 2020

(54) BORDER WALL

(71) Applicant: The Modern Group, Ltd., Beaumont, TX (US)

(72) Inventors: Gary R. Markham, Lumberton, TX (US); Will Block Crenshaw, Beaumont, TX (US)

(73) Assignee: The Modern Group, Ltd., Beaumont, TX (US)

( * ) Notice: Subject to any disclaimer, the term of this patent is extended or adjusted under 35 U.S.C. 154(b) by 436 days.

(21) Appl. No.: 15/937,953

(22) Filed: Mar. 28, 2018

(65) Prior Publication Data

US 2018/0283041 A1 Oct. 4, 2018

Related U.S. Application Data

(60) Provisional application No. 62/477,620, filed on Mar. 28, 2017.

(51) Int. Cl.

| | |
|---|---|
| ***E04H 17/16*** | (2006.01) |
| ***E01F 13/02*** | (2006.01) |
| ***E01F 13/12*** | (2006.01) |
| ***E04H 17/14*** | (2006.01) |
| *E04B 2/02* | (2006.01) |
| *E04B 1/19* | (2006.01) |
| *E04B 1/24* | (2006.01) |
| *E04B 1/35* | (2006.01) |

(52) U.S. Cl.

CPC ..... *E04H 17/16* (2013.01); *E01F 13/02* (2013.01); *E01F 13/022* (2013.01); *E01F 13/12* (2013.01); *E04H 17/1404* (2013.01); *E04B 1/24* (2013.01); *E04B 1/35* (2013.01); *E04B 2001/199* (2013.01); *E04B 2001/1993* (2013.01); *E04B 2001/2463* (2013.01); *E04B 2001/2481* (2013.01); *E04B 2002/0202* (2013.01); *E04B 2002/0263* (2013.01); *E04B 2103/06* (2013.01)

(58) Field of Classification Search

CPC .... E01F 13/02; E01F 13/022; E04H 17/1404; B65D 88/022; B65D 90/0013; B65D 90/0026

See application file for complete search history.

(56) References Cited

U.S. PATENT DOCUMENTS

| | | | | |
|---|---|---|---|---|
| 5,022,781 | A * | 6/1991 | Smith | E01F 7/06 181/210 |
| 5,123,773 | A * | 6/1992 | Yodock | E01F 15/088 256/13.1 |
| 5,237,784 | A * | 8/1993 | Ros | B60P 1/6427 52/67 |
| 5,244,172 | A * | 9/1993 | Allega | E01F 9/669 248/161 |
| 5,292,467 | A * | 3/1994 | Mandish | E01F 15/0476 256/1 |
| 6,474,904 | B1 * | 11/2002 | Duckett | E01F 15/086 256/13.1 |
| 6,668,484 | B2 * | 12/2003 | Riccobene | A01G 9/28 47/33 |

(Continued)

*Primary Examiner* — Daniel J Wiley

(74) *Attorney, Agent, or Firm* — Adolph Locklar

(57) ABSTRACT

A plurality of base units is loaded onto a plurality of trailers. The plurality of trailers is coupled to a plurality of trucks. The plurality of trucks is transported to a construction site. The plurality of base units is unloaded from the plurality of trailers and placed at the construction site to form a wall.

9 Claims, 10 Drawing Sheets

(56) References Cited

U.S. PATENT DOCUMENTS

| | | | | |
|---|---|---|---|---|
| 7,144,186 | B1 * | 12/2006 | Nolte | E01F 15/083 404/6 |
| 7,354,218 | B1 * | 4/2008 | Dyke | E01F 15/006 404/6 |
| 8,545,126 | B1 * | 10/2013 | Alsaffar | E01F 15/088 404/6 |
| 8,647,012 | B2 * | 2/2014 | Wilkinson | E01F 15/12 404/6 |
| 9,481,969 | B2 * | 11/2016 | Groeneweg | E01F 15/00 |

* cited by examiner

BORDER WALL

CROSS-REFERENCE TO RELATED APPLICATION

This application claims the benefit of U.S. Provisional Application No. 62/477,620, filed on Mar. 28, 2017, which is incorporated by reference.

BACKGROUND

A border wall, i.e., is a wall placed at a border and designed to discourage crossing of the border from an incursion side of the wall to a protected side of the wall. It is a challenge to quickly and efficiently build a border wall.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Figure 1A:
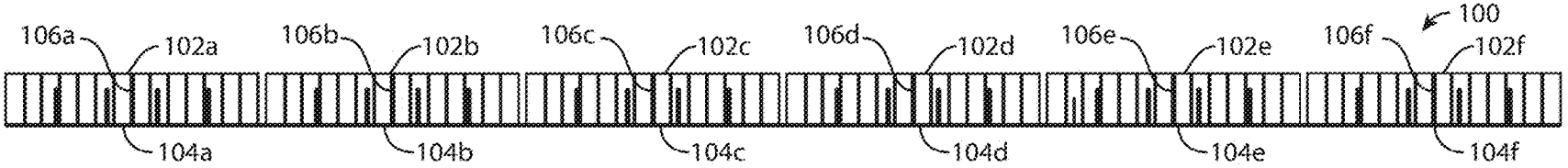
FIG. 1A is a plan view of a wall from a top.
Figure 1B:
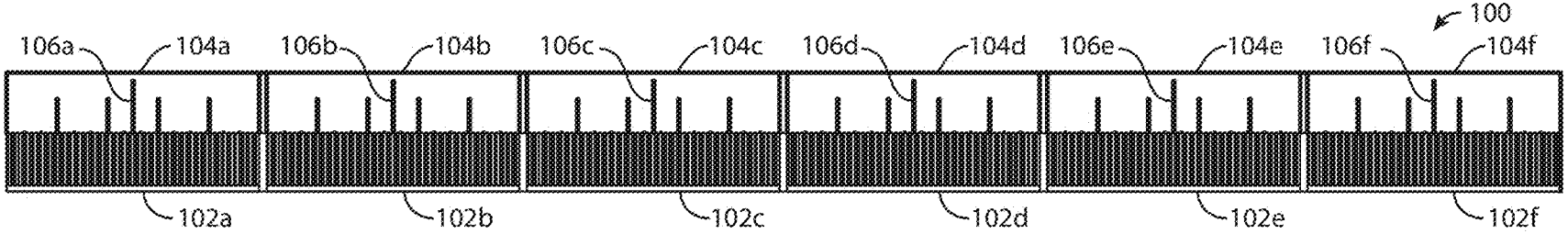
FIG. 1B is a plan view of a wall from a protected side.
Figure 1C:
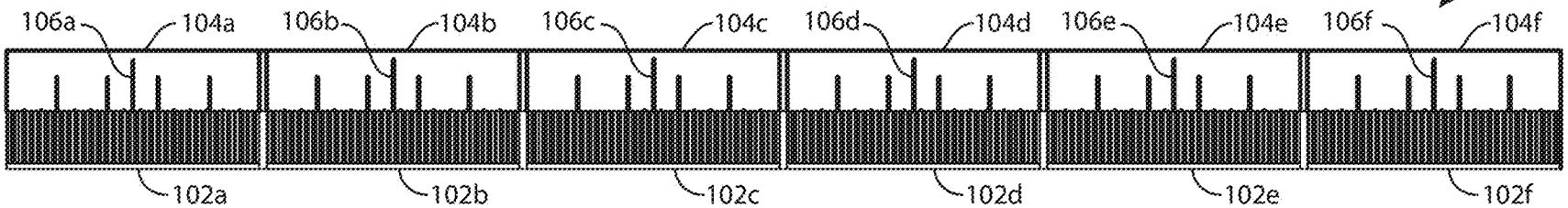
FIG. 1C is a plan view of a wall from an incursion side.

General:

A wall 100, shown from above in FIG. 1A, from the protected side in FIG. 1B, and from the incursion side in FIG. 1C, includes a base system of carbon steel fabricated base units 102*a*, 102*b*, 102*c*, etc., placed in line end to end. Additional steel plate structures 104*a*, 104*b*, 104*c*, etc., supported by structural supports 106*a*, 106*b*, 106*c*, etc. (only one structural support per base unit is labeled) may be placed on top of the base units to result in an overall wall height of 20 feet. There are approximately 126 base units 102*a*, 102*b*, etc. per mile of wall 100. The linear weight of the 20' tall wall 100 is approximately 750 lbs per running foot. The base units 102*a*, 102*b*, etc. and steel plate structures 104*a*, 104*b*, etc. may be painted a Bureau of Land Management approved color or other specified color. It will be understood that while FIGS. 1A, 1B, and 1C show six base units 102*a*, 102*b*, etc., and six steel plate structures 104*a*, 104*b*, etc., resulting in a length of approximately 258 feet, the wall 100 may include many more such structures and may run for many miles.

Figure 2A:
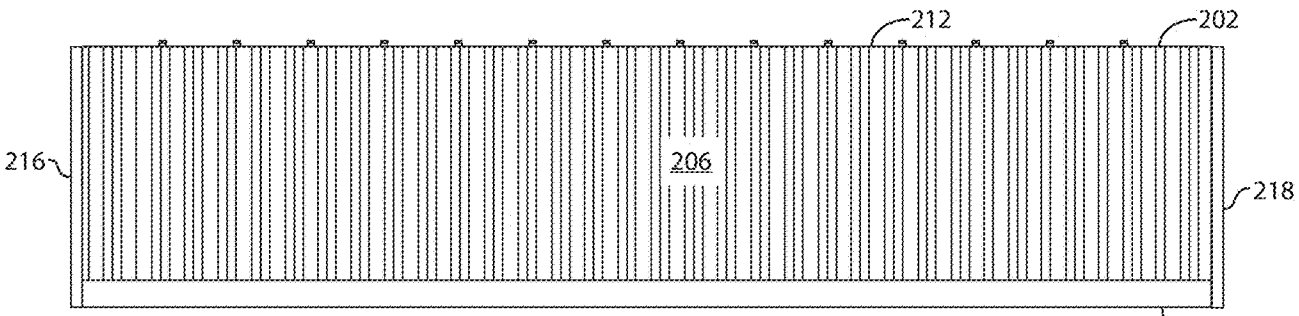
FIG. 2A is a plan view of a base unit from the incursion side.
Figure 2B:
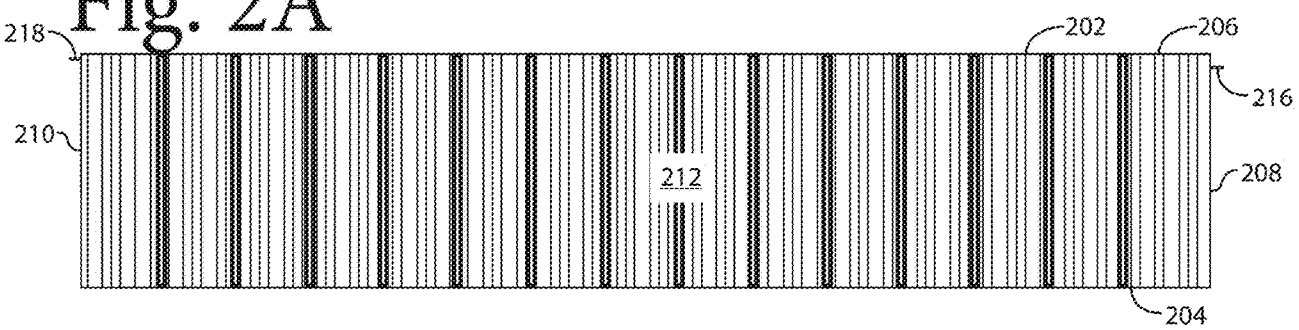
FIG. 2B is a plan view of a base unit from the top.
Figure 2C:
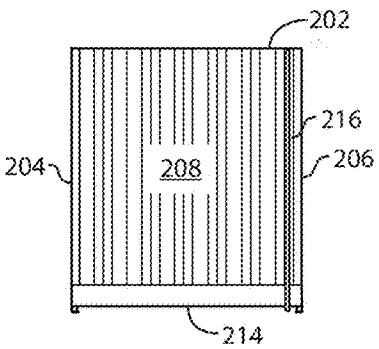
FIG. 2C is a plan view of a base unit from the side.

Base System:

A representative base unit 202, shown from the incursion side in FIG. 2A, from the top in FIG. 2B and from the side (with the incursion side to the right) in FIG. 2C which is representative of the base units 102*a*, 102*b*, etc. illustrated in FIGS. 1A-1C, is 42 feet long, 8 feet wide, 10 feet high, and weighs 25,300 pounds, although it will be understood that these dimensions can be varied. For example, the base unit 202 may be a re-purposed container for fracing fluids, which have substantial walls designed to withstand the stresses of the fracing environment, or the base unit 202 may have the dimensions of a standard shipping container with fortified walls. Other dimensions are possible.

Figure 3A:
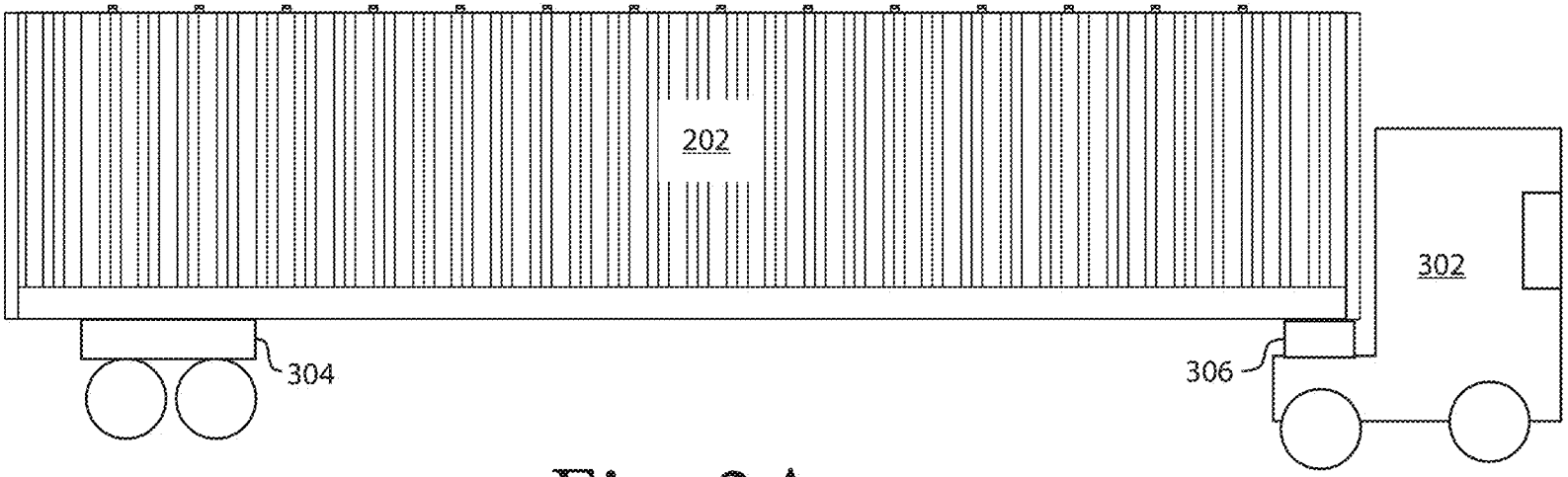
FIG. 3A is a plan view of a base unit with a detachable axle and a detachable coupling coupled to a truck.
Figure 3B:
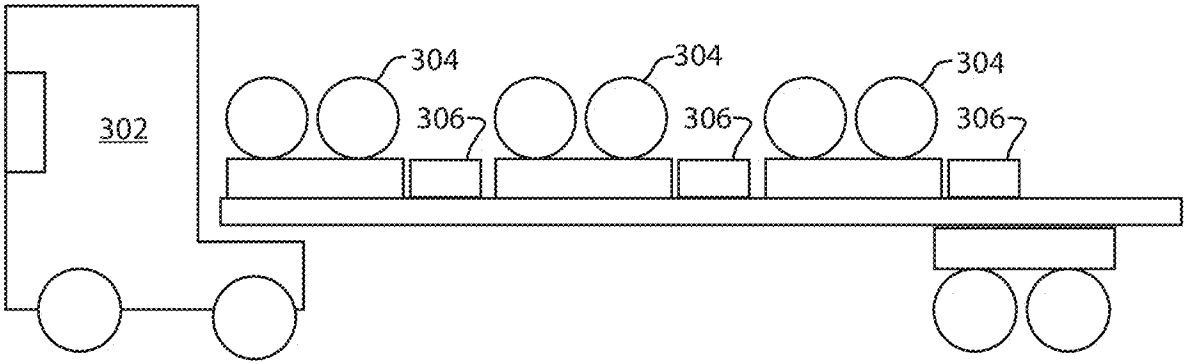
FIG. 3B is a plan view of a truck transporting a plurality of detachable axles and detachable couplings.

The base unit 202 has a protected face 204, an incursion face 206 opposite the protected face 204, a first face 208 between the protected face 204 and the incursion face 206, a second face 210 between the protected face 204 and the incursion face 206 and opposite the first face 208, a top 212 coupled to the protected face 204, the incursion face 206, the first face 208, and the second face 210, a bottom 214 coupled to the protected face 204, the incursion face 206, the first face 208, and the second face 210 and opposite the top 212, Each base unit 202 is mobile for transport to the construction site, for example by a truck 302 as shown in FIG. 3A, facilitating ease of placement and reduced construction time. The base unit 202 may be loaded on a trailer (not shown) or it may have a detachable axle 304 and coupling 304, as shown in FIG. 3A. The transport components 304, 306 are removed from the base units 202 before the units 202 are placed in line in the wall 100. The transport components 304, 306 may be transported to the manufacturing location, as shown in FIG. 3B, for example by the truck 302 that delivered the base unit 202 to the construction site.

Figure 4A:
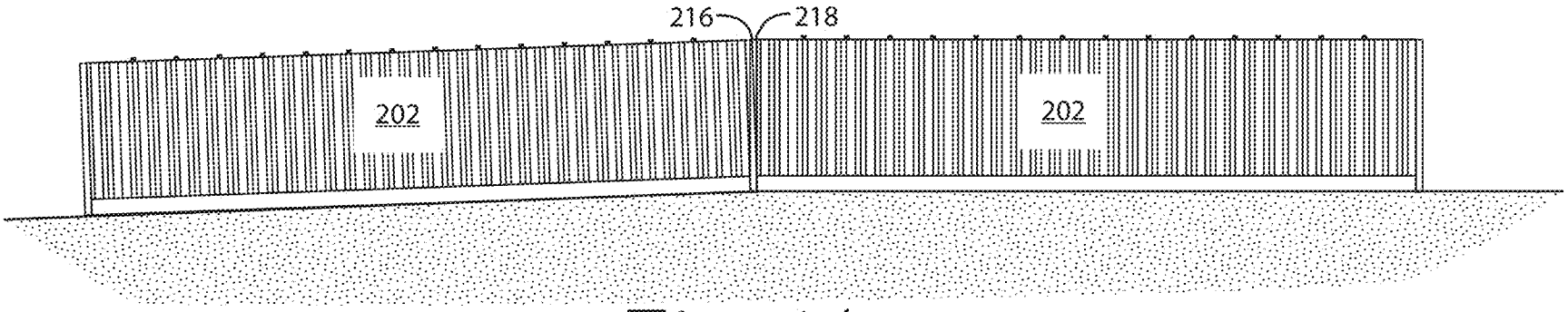
FIG. 4A shows two base units on a hill.
Figure 4B:
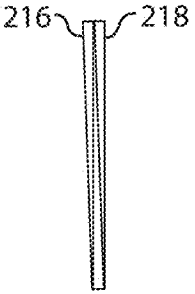
FIG. 4B shows the overlap between the first overlapping structure and the second overlapping structure.

Placement of the base units 102*a*, 102*b*, etc. creates an instant barrier to passage. Base units 202 are tightly abutted to each other end to end, each with mating overlapping structures, i.e., first overlapping structure 216 extending from the first face 208, and second overlapping structure 218 extending from the second face 210 (see FIGS. 2A-2C) to allow for variations in level and plumb with respect to each adjacent base unit 202. In one or more embodiments, the first overlapping structure 216 is set back from the incursion face 206 of the base unit 202 by a different amount than the second overlapping structure 218 to allow the two overlapping structures 216, 218 to overlap, as shown in FIG. 4A, which shows two base units that are misaligned because of their location on a hill, and 4B, which shows the overlapping structures 216, 218. Once in place, the overlapping structures 216, 218 can be welded together or bolted together or otherwise secured to prevent or limit relative movement.

The effective base unit 202 barrier length, including the overlapping structures 216, 218, is approximately 43 feet per unit. The large size and weight of the base units 202 provides a formidable barrier, with an extremely high stability foot print, without the need for additional foundation work, such as footings, posts, or pilings. The base units 202 are not readily moved by impact or other envisioned methods. As a result of the wide base of the base units 202 ease of tunneling under the base units 202 is also reduced. In one or more embodiments, base unit 202 walls are ¼" steel plate with strengthening corrugations. In one or more embodiments, there is no access into the interior of the base unit.

Below Grade Barrier System

Figure 5A:
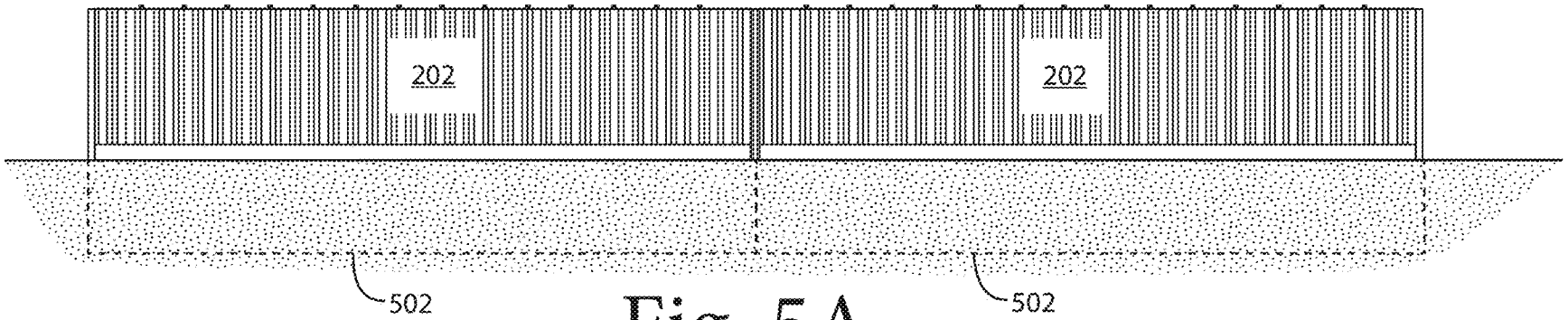
FIG. 5A shows a below grade barrier system.
Figure 5B:
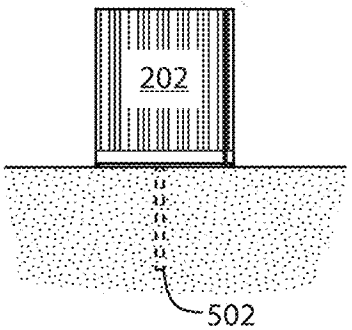
FIG. 5B shows a below grade barrier system.

Before placement of a base unit system consisting of a set of base units 202, a below grade barrier 502 can be installed by placing sheet piling (type structure) materials in a continuous path, in line with the placement of the base units 202. In one or more embodiments, the depth of the below grade barrier 502 is 4 to 6 feet, but it will be understood that the depth can be varied. Further, while FIG. 5B shows the below grade barrier 502 installed directly below the center of the base unit 202, it will be understood that the below grade barrier 502 can be installed anywhere beneath the base unit 202 and even a few inches on either side of the footprint of the base unit 202 and still perform the function of below grade barrier 502. The installation of the below grade barrier 502 is typically accomplished by either trenching and back filling or driving the barrier plates. This would be done after all surface and grade preparation is completed to ensure the proper relation between the top of the below grade barrier 502 and the bottom of the base unit 202.

Figure 6C:
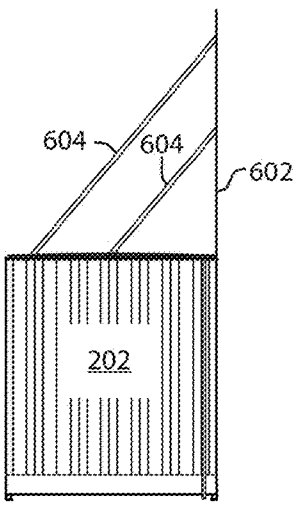
FIG. 6C shows a base unit with a upper barrier section from the side.
Figure 6A:
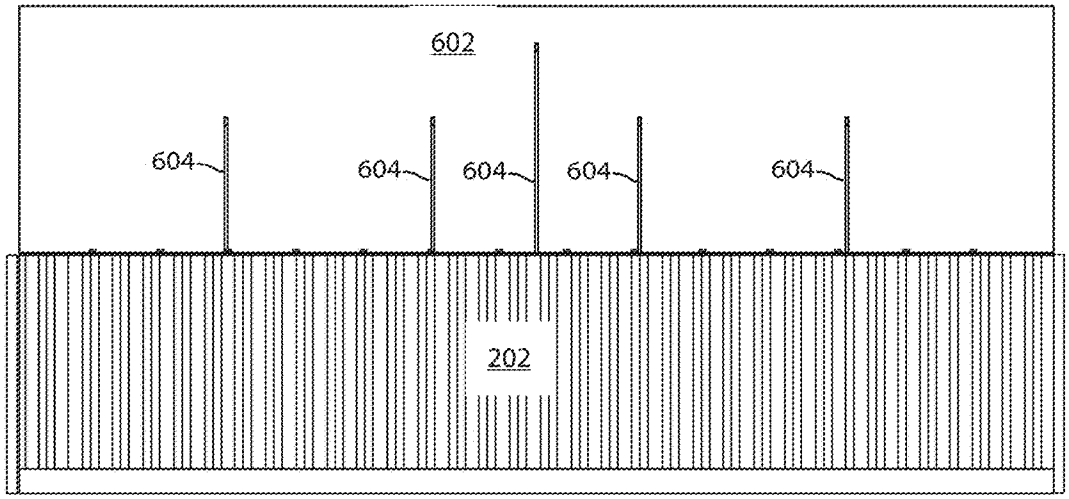
FIG. 6A shows a base unit with a upper barrier section from the protected side.
Figure 6B:
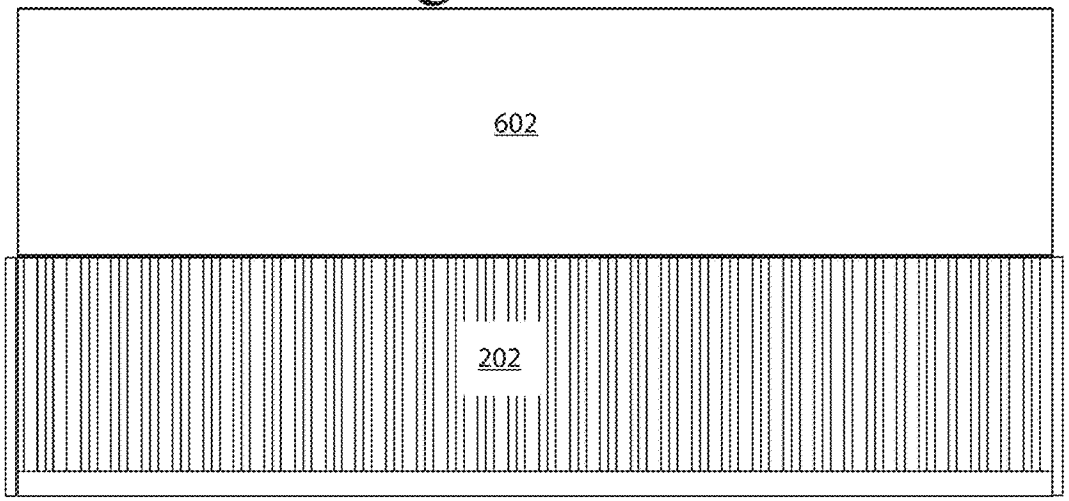
FIG. 6B shows a base unit with a upper barrier section from the incursion side.

Upper Wall System:

Subsequent to placement of the base units 202, an additional 10 foot high upper barrier section 602, shown in FIG. 6A from the protected side, in FIG. 6B from the incursion side, and in FIG. 6C from the side with the incursion side to the right on the drawing, is placed on top of the base units 202 resulting in an overall barrier height of 20 feet. The upper barrier section 602 is fabricated from ¼ inch steel plate with strengthening corrugations and structural member framing including support knee bracing 604 (corresponding to structural supports 106*a*, 106*b*, etc. in FIG. 1) to base unit 202 roofs. The pattern of the upper barrier sections 602 follows the pattern of the base units 202. The upper barrier sections 602 are attached to the base sections 202 using tamper proof methods and materials.

Figure 7A:
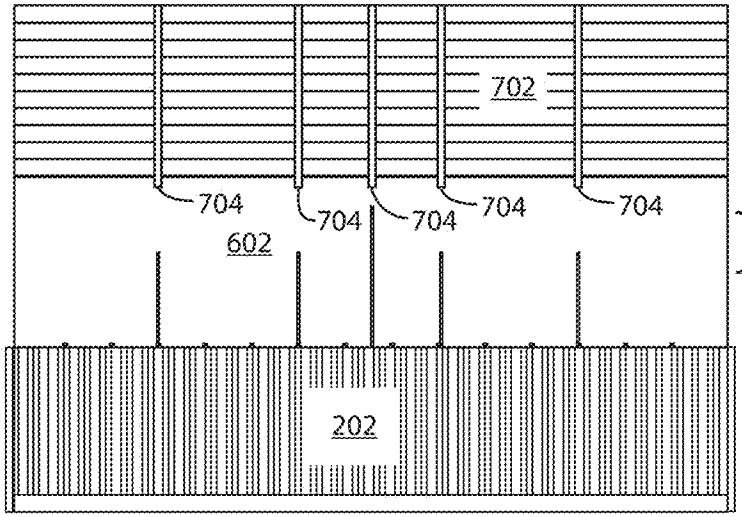
FIG. 7A shows a base unit with a high barrier section from the protected side.
Figure 7B:
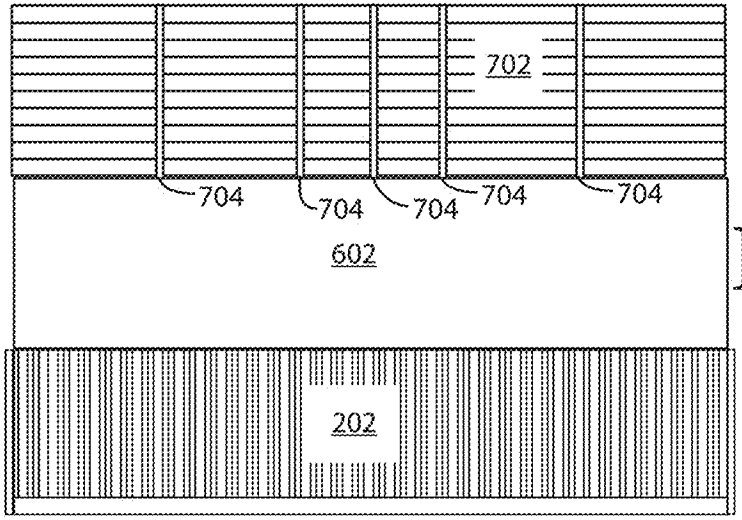
FIG. 7B shows a base unit with a high barrier section from the incursion side.
Figure 7C:
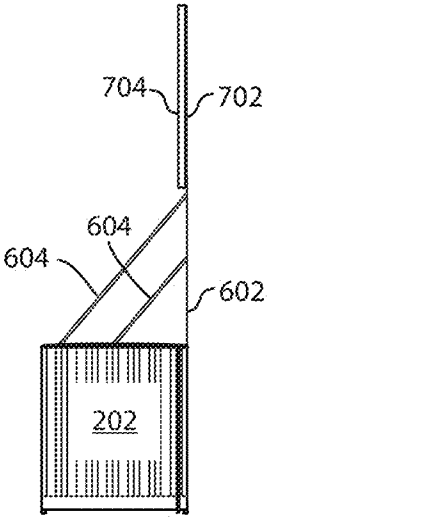
FIG. 7C shows a base unit with a high barrier section from the side.

An additional 10 foot high barrier section 702, shown in FIG. 7A from the protected side, in FIG. 7B from the incursion side, and in FIG. 7C from the side with the incursion side to the right on the drawing, can be installed above the upper barrier section 602 resulting in a total barrier height of 30 feet. In one or more embodiments, the high barrier section 702 is constructed using horizontal wire or other approved open air flow system with vertical posts 704. The higher barrier section 702 is attached to the upper barrier section 602 using tamper proof methods and materials.

Figure 8:
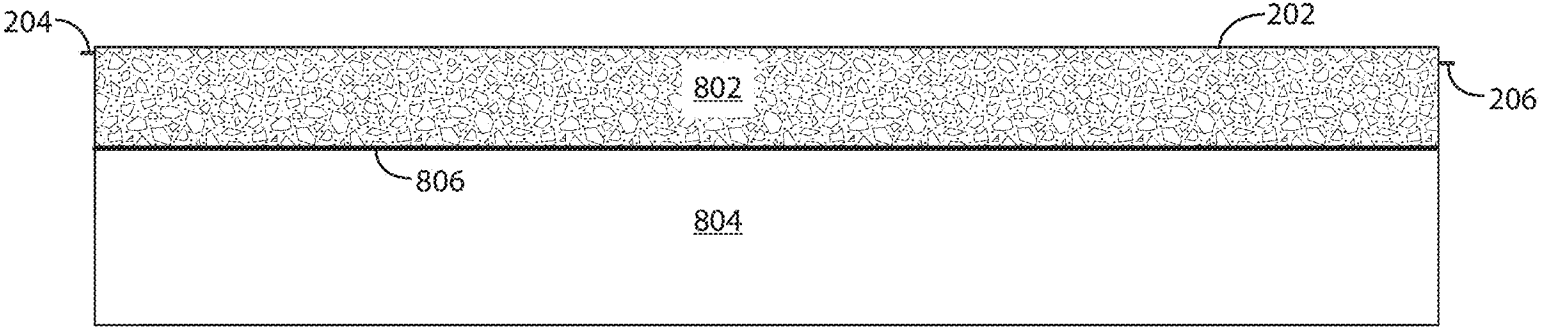
FIG. 8 is a cross-sectional view of a partitioned base unit.

Partitioned Base Unit:

The base unit 202 may be partitioned into two or more chambers 802, 804 by an internal partition 806, as shown in FIG. 8. While FIG. 8 shows a single partition 806 and two chambers 802, 804, it will be understood that the base unit 202 can be further partitioned by the addition of additional partitions. Each partition 806 provides an additional barrier to penetration—e.g., partition 806 converts base unit 202 from a two-walled barrier to a three-walled barrier.

One or more of the chambers 802, 804 can be filled with concrete, gravel, sand, general debris, or other material to provide additional barriers to penetration. In FIG. 8, partition 802 is shown filled with such a material. The partition 802, 804 can be filled before or after installation at the construction site.

Figure 9:
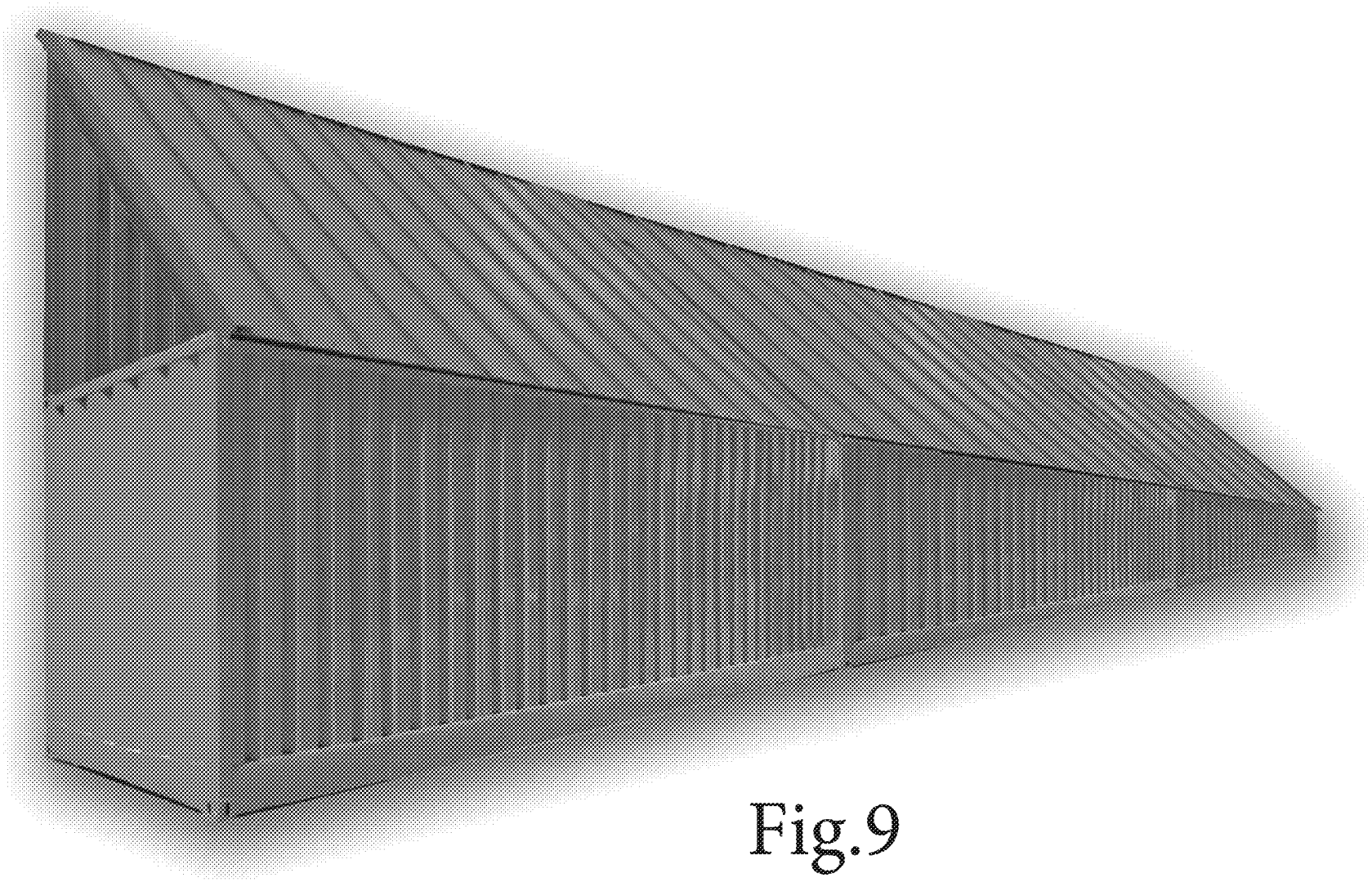
FIG. 9 is a perspective view of a protected side of a wall having aesthetic elements.
Figure 10:
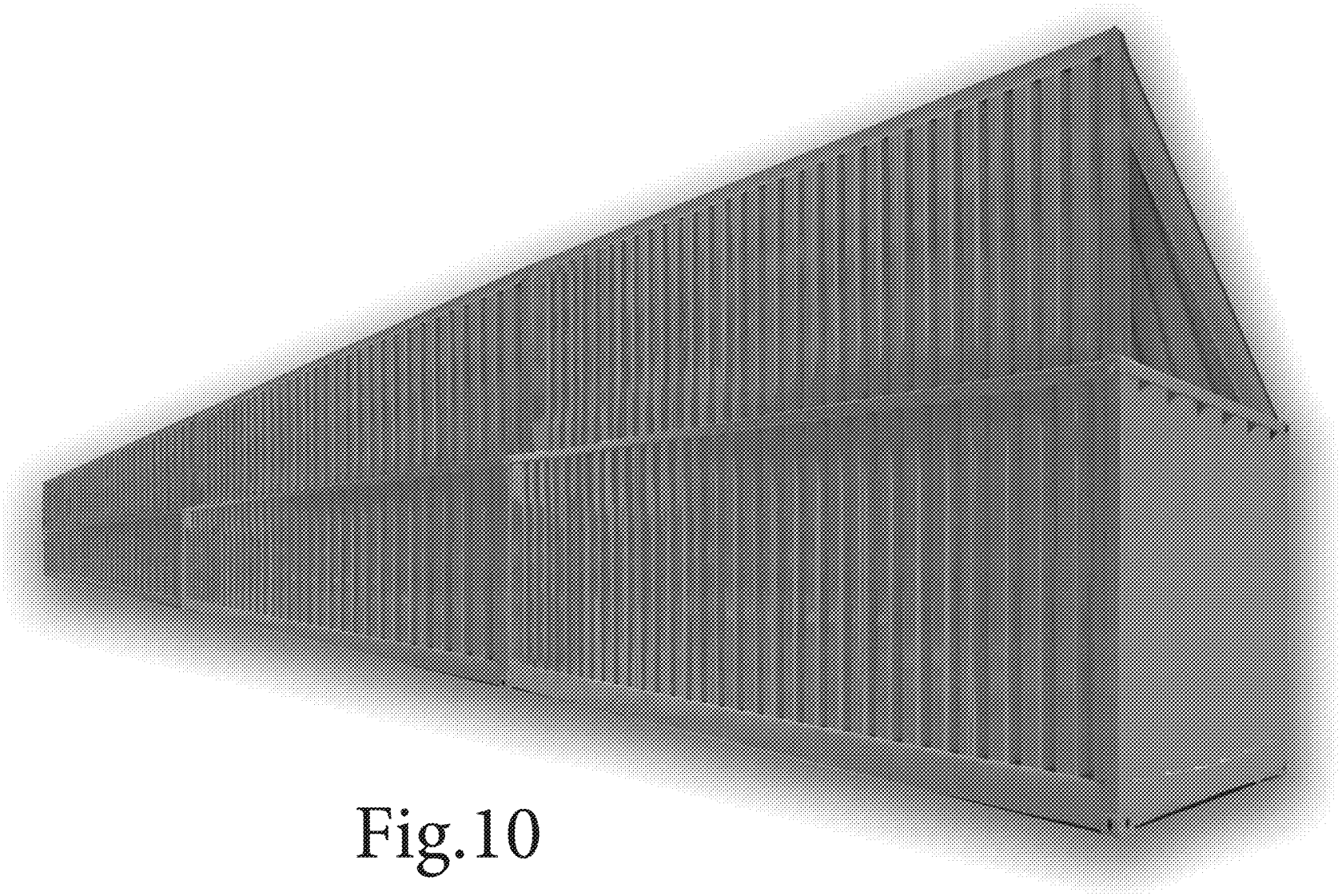
FIG. 10 is a perspective view of an incursion side of a wall having aesthetic elements.

Better Aesthetic Presentation:

In one or more embodiments, the structural supports 106*a*, 106*b*, etc., 604 are replaced by corrugated sheets of metal, as shown in FIGS. 9 and 10, which provides a more pleasing appearance. In one or more embodiments, the corrugated sheets of metal are made from R-panel metal roofing material.

Construction/Installation Scope:

The design of the wall 100 is suitable for installation with semi improved road access and the following site conditions. The installation surface is reasonably gradable using industry standard medium sized surface preparation equipment, a gradable sloping elevational change of 10% in 500 feet or less (with no fill material needed). Gradable and stair stepped elevational changes up to 20% in 500 feet can be accommodated using sectional steel infill panels between base units to accommodate stair stepping of base units.

In one aspect, an apparatus includes a base unit. The base unite has a protected face, an incursion face opposite the protected face, a first face between the protected face and the incursion face, a second face between the protected face and the incursion face and opposite the first face, a top coupled to the protected face, the incursion face, the first face, and the second face, a bottom coupled to the protected face, the incursion face, the first face, and the second face and opposite the top, a first overlapping structure extending from the first face and adjacent to and set back from the incursion face by a first amount, and a second overlapping structure extending from the second face and adjacent to and set back from the incursion face by a second amount. The first amount is different from the second amount and the dimensions of the first overlapping structure and the second overlapping structure are such that placing two base units next to each other so that the first face of a first of the two base units faces the second face of a second of the two base units causes the first overlapping structure from the first of the two base units to overlap and be securable to the second overlapping structure from the second of the two base units, so that a gap between the first base unit and the second base unit is closed even if a bottom of the first base unit is not aligned with a bottom of the second base unit.

Implementations may include one or more of the following. The apparatus may include an upper barrier section extending upward from and parallel to the incursion face of the base unit. The apparatus may include a high barrier section extending upward from and parallel to the upper barrier section. The apparatus may include a below grade section extending into the earth below the base unit. The apparatus may include a partition between the protected face and the incursion face, extending from the first face to the second face, and dividing an interior of the base unit into a plurality of chambers. One of the plurality of chambers may be filled with a material. The base unit may include fittings whereby the base unit can be lifted by a crane and placed by the crane into a desired location at a construction site. The apparatus may include an axle system couplable to the base unit and a coupling system couplable to the base unit. The base unit with the axle system and the coupling system may be couplable to a truck for road transportation.

In one aspect, a method includes loading a plurality of base units onto a plurality of trailers, coupling the plurality of trailers to a plurality of trucks, transporting the plurality of trucks to a construction site, and unloading the plurality of base units from the plurality of trailers and placing them at the construction site to form a wall.

In one aspect, a method includes attaching detachable axles and detachable couplings to a plurality of base units at a manufacturing site, coupling the plurality of base units to a plurality of trucks using the detachable couplings, transporting the plurality of trucks to a construction site, detaching the detachable axles and the detachable couplings, placing the plurality of base units at the construction site to form a wall, and transporting the detached detachable axles and detachable couplings to the manufacturing site.

Implementations may include one or more of the following. Each base unit may have a protected face, an incursion face opposite the protected face, a first face between the protected face and the incursion face, a second face between the protected face and the incursion face and opposite the first face, a top coupled to the protected face, the incursion face, the first face, and the second face, a bottom coupled to the protected face, the incursion face, the first face, and the second face and opposite the top, a first overlapping structure extending from the first face and adjacent to and set back from the incursion face by a first amount, and a second overlapping structure extending from the second face and adjacent to and set back from the incursion face by a second amount. Placing the base units at the construction site to form a wall may include coupling the first overlapping structure extending from the first face of a first of the plurality of base units to the second overlapping structure extending from the second face of a second base unit adjacent to the first base unit so that a gap between the first base unit and the second base unit is closed even if a bottom of the first base unit is not aligned with a bottom of the second base unit.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus comprising:

a base unit having:

a protected face, an incursion face opposite the protected face, a first face between the protected face and the incursion face, a second face between the protected face and the incursion face and opposite the first face, a top coupled to the protected face, the incursion face, the first face, and the second face, a bottom coupled to the protected face, the incursion face, the first face, and the second face and opposite the top, a first overlapping structure extending from the first face and adjacent to and set back from the incursion face by a first amount, and a second overlapping structure extending from the second face and adjacent to and set back from the incursion face by a second amount, wherein the first amount is different from the second amount and the dimensions of the first overlapping structure and the second overlapping structure are such that placing two base units next to each other so that the first face of a first of the two base units faces the second face of a second of the two base units causes the first overlapping structure from the first of the two base units to overlap and be securable to the second overlapping structure from the second of the two base units, so that a gap between the first face of the first base unit and the second face of the second base unit is closed even if the bottom of the first base unit is not coplanar with the bottom of the second base unit.

2. The apparatus of claim 1 further comprising:

an upper barrier section extending upward from and parallel to the incursion face of the base unit.

3. The apparatus of claim 2 further comprising:

a high barrier section extending upward from and parallel to the upper barrier section.

4. The apparatus of claim 1 further comprising:

a below grade section extending into the earth below the base unit.

5. The apparatus of claim 1 wherein the base unit further comprises:

a partition between the protected face and the incursion face, extending from the first face to the second face, and dividing an interior of the base unit into a plurality of chambers.

6. The apparatus of claim 5 wherein one of the plurality of chambers is filled with a material.

7. The apparatus of claim 1 wherein the base unit further comprises fittings whereby the base unit can be lifted by a crane and placed by the crane into a desired location at a construction site.

8. The apparatus of claim 1 further comprising:

an axle system couplable to the base unit; and a coupling system couplable to the base unit;

wherein the base unit with the axle system and the coupling system are couplable to a truck for road transportation.

9. A method comprising:

attaching detachable axles and detachable couplings to a plurality of base units as claimed in claim 1 at a manufacturing site;

coupling the plurality of base units to a plurality of trucks using the detachable couplings;

transporting the plurality of trucks to a construction site;

detaching the detachable axles and the detachable couplings;

placing the plurality of base units at the construction site to form a wall; and transporting the detached detachable axles and detachable couplings to the manufacturing site.

* * * * *